US011731017B2

(12) United States Patent
Douglas et al.

(10) Patent No.: US 11,731,017 B2
(45) Date of Patent: Aug. 22, 2023

(54) ADJUSTABLE FLEX ROD CONNECTION FOR BALL BATS AND OTHER SPORTS IMPLEMENTS

(71) Applicant: EASTON DIAMOND SPORTS, LLC, Thousand Oaks, CA (US)

(72) Inventors: Grant Douglas, Seattle, WA (US); Dewey Chauvin, Simi Valley, CA (US); Linda Hunt, Simi Valley, CA (US)

(73) Assignee: EASTON DIAMOND SPORTS, LLC, Thousand Oaks, CA (US)

( * ) Notice: Subject to any disclaimer, the term of this patent is extended or adjusted under 35 U.S.C. 154(b) by 149 days.

(21) Appl. No.: 17/308,760

(22) Filed: May 5, 2021

(65) Prior Publication Data

US 2021/0252359 A1 Aug. 19, 2021

Related U.S. Application Data

(63) Continuation of application No. 15/935,896, filed on Mar. 26, 2018, now Pat. No. 11,013,968.

(51) Int. Cl.

| | |
|---|---|
| ***A63B 59/51*** | (2015.01) |
| ***A63B 59/52*** | (2015.01) |
| ***A63B 60/00*** | (2015.01) |

(52) U.S. Cl.

CPC ..... *A63B 59/51* (2015.10); *A63B 59/52* (2015.10); *A63B 60/0081* (2020.08); *A63B 2209/00* (2013.01)

(58) Field of Classification Search

CPC ..... A63B 59/51; A63B 59/52; A63B 60/0081; A63B 2209/00; A63B 60/08; A63B 60/42;

(Continued)

(56) References Cited

U.S. PATENT DOCUMENTS 537,927 A 4/1895 Kennedy
546,540 A 9/1895 Kennedy
(Continued)

FOREIGN PATENT DOCUMENTS

JP H07163693 A 6/1995

OTHER PUBLICATIONS

ASTM International , "F2398-11: Standard Test Method for Measuring Moment of Inertia and Center of Percussion of a Baseball or Softball Bat", edition approved Apr. 1, 2011, published May 2011.

(Continued)

*Primary Examiner* — Jeffrey S Vanderveen
(74) *Attorney, Agent, or Firm* — Perkins Coie LLP

(57) ABSTRACT

A ball bat includes a barrel portion, a handle portion, and a joint connecting the handle portion to the barrel portion. In some embodiments, the joint includes a releasable connector configured to releasably connect the barrel portion to the handle portion. In some embodiments, the joint includes two releasable connectors to releasably connect the barrel portion to the handle portion. The ball bat may include a flexible rod element positioned between the two releasable connectors. The rod element may include an elastomeric material. In some embodiments, the ball bat may further include a safety connector between the barrel portion and the handle portion or a releasable connector may include a threaded connection to resist release of the releasable connector. In some embodiments, the joint may include a rotatable element for adjusting flex.

25 Claims, 11 Drawing Sheets

(58) Field of Classification Search
CPC ..... A63B 60/50; A63B 60/54; A63B 71/0054; A63B 2071/0694; A63B 2102/18; A63B 2102/182; A63B 2210/50; A63B 2225/09
See application file for complete search history.

(56) References Cited

U.S. PATENT DOCUMENTS 1,026,990 A 5/1912 Matson
1,509,733 A 9/1924 Henry
1,650,183 A 11/1927 Brooks
2,475,927 A 7/1949 Joseph
3,116,926 A 1/1964 Owen et al.
3,830,496 A 8/1974 Reizer
3,861,682 A 1/1975 Fujii
3,876,204 A 4/1975 Moore et al.
3,877,698 A 4/1975 Volpe
3,897,058 A 7/1975 Koch
3,955,816 A 5/1976 Bratt
3,963,239 A 6/1976 Fujii
4,025,377 A 5/1977 Tanikawa
4,032,143 A 6/1977 Mueller et al.
4,056,267 A 11/1977 Krieger
4,113,248 A 9/1978 Yanagioka
4,323,239 A 4/1982 Ishii
4,351,786 A 9/1982 Mueller
4,399,996 A * 8/1983 Boyce ..... A63B 69/0002 473/457
4,505,479 A 3/1985 Souders
4,569,521 A 2/1986 Mueller
4,572,508 A 2/1986 You
4,600,193 A 7/1986 Merritt
4,746,117 A 5/1988 Noble et al.
4,834,370 A 5/1989 Noble et al.
4,848,745 A 7/1989 Bohannan et al.
4,898,386 A 2/1990 Anderson
4,951,948 A 8/1990 Peng
4,961,576 A 10/1990 Meredith
5,104,123 A 4/1992 Okitsu et al.
5,114,144 A 5/1992 Baum
5,131,651 A 7/1992 You
5,180,163 A 1/1993 Lanctot et al.
5,219,164 A 6/1993 Peng
5,277,421 A 1/1994 Rewolinski
5,303,917 A 4/1994 Uke
D347,671 S 6/1994 Weiss et al.
5,380,003 A 1/1995 Lanctot
5,409,214 A 4/1995 Cook
5,415,398 A 5/1995 Eggiman
5,456,461 A 10/1995 Sullivan
5,511,777 A 4/1996 Mcneely
5,516,097 A 5/1996 Huddleston
5,593,158 A 1/1997 Filice et al.
5,674,138 A 10/1997 Nolan
5,676,609 A 10/1997 Mollebaek
5,711,726 A 1/1998 Powers
5,722,908 A 3/1998 Feeney et al.
5,820,438 A 10/1998 Horton
5,833,561 A 11/1998 Kennedy et al.
6,048,283 A 4/2000 Albarelli
6,050,908 A 4/2000 Muhlhausen
6,053,828 A 4/2000 Pitsenberger
6,056,655 A 5/2000 Feeney et al.
6,099,422 A 8/2000 Rappaport et al.
6,173,610 B1 1/2001 Pace
6,280,353 B1 8/2001 Brundage
6,287,222 B1 9/2001 Pitsenberger
6,344,007 B1 2/2002 Feeney et al.
6,398,675 B1 6/2002 Eggiman et al.
6,402,634 B2 6/2002 Lee et al.
6,406,387 B1 6/2002 Ryan
6,432,006 B1 8/2002 Tribble
6,482,114 B1 11/2002 Eggiman et al.
6,485,382 B1 11/2002 Chen
6,497,631 B1 12/2002 Fritzke et al.
6,511,392 B1 1/2003 Chohan
6,547,673 B2 4/2003 Roark
6,569,042 B2 5/2003 Lachance et al.
6,612,945 B1 9/2003 Anderson
6,625,848 B1 9/2003 Schneider
6,663,517 B2 12/2003 Buiatti et al.
D485,876 S 1/2004 Andrews
6,729,983 B1 5/2004 Vakili et al.
6,733,404 B2 5/2004 Fritzke et al.
6,743,127 B2 6/2004 Eggiman et al.
6,758,771 B2 7/2004 Tribble
6,761,653 B1 7/2004 Higginbotham et al.
6,808,464 B1 10/2004 Nguyen
6,824,482 B1 11/2004 Tribble
6,872,156 B2 3/2005 Ogawa et al.
6,878,080 B2 4/2005 Chang
6,939,237 B1 9/2005 Voden
6,945,886 B2 9/2005 Eggiman et al.
7,011,588 B2 3/2006 Fritzke et al.
7,014,580 B2 3/2006 Forsythe et al.
7,097,578 B2 8/2006 Guenther et al.
7,140,248 B1 11/2006 Brundage
7,140,987 B2 11/2006 Davis et al.
7,140,988 B1 11/2006 Hinman
7,147,580 B2 12/2006 Nutter et al.
7,163,475 B2 1/2007 Giannetti
7,171,697 B2 2/2007 Vito et al.
7,201,679 B2 4/2007 Nguyen
7,235,024 B2 6/2007 Lefebvre et al.
7,297,077 B1 11/2007 Battaglino
7,320,653 B2 1/2008 Fitzgerald et al.
7,344,461 B2 3/2008 Van
7,377,866 B2 5/2008 Van
7,377,867 B1 5/2008 Vacek et al.
7,381,141 B2 * 6/2008 Van Nguyen ..... A63B 59/50 473/566
7,410,433 B2 8/2008 Guenther et al.
7,419,446 B2 9/2008 Nguyen
7,442,134 B2 10/2008 Giannetti et al.
7,442,135 B2 10/2008 Giannetti et al.
7,534,180 B1 5/2009 Vacek et al.
7,572,197 B2 8/2009 Chauvin et al.
7,585,235 B2 9/2009 Misono et al.
7,704,159 B1 4/2010 Mcdonald
7,749,115 B1 7/2010 Cruz et al.
7,798,926 B1 9/2010 Hsu
7,837,579 B2 11/2010 Bhatt et al.
7,850,553 B2 12/2010 Goldsmith et al.
7,862,456 B2 1/2011 Halko et al.
7,867,114 B2 1/2011 Sutherland et al.
7,909,705 B2 3/2011 Gill et al.
7,942,764 B2 5/2011 Chung
7,955,200 B1 6/2011 Cruz et al.
8,052,547 B2 11/2011 Nusbaum et al.
8,142,382 B2 3/2012 Vito et al.
8,197,365 B2 6/2012 Tokieda
8,206,250 B1 6/2012 Cruz et al.
8,226,505 B2 7/2012 Burger
8,277,343 B2 10/2012 Chang
8,297,601 B2 10/2012 Vito et al.
8,313,397 B2 11/2012 Watari et al.
8,317,640 B1 11/2012 Cruz et al.
8,413,262 B2 4/2013 Vito et al.
8,425,353 B2 4/2013 Jones et al.
8,449,412 B2 5/2013 Vander et al.
8,491,423 B1 7/2013 Biggio et al.
8,512,174 B2 8/2013 Epling et al.
8,512,175 B2 8/2013 Epling et al.
8,512,176 B1 8/2013 Mathew et al.
8,545,966 B2 10/2013 Vito et al.
8,715,118 B2 5/2014 Epling et al.
D711,989 S 8/2014 Goodwin et al.
8,814,733 B2 8/2014 Tsukamoto et al.
8,827,846 B2 9/2014 Shocklee
8,894,518 B2 11/2014 Chung
8,998,753 B2 4/2015 Tinti
8,998,754 B2 4/2015 Shocklee et al.
9,101,810 B2 8/2015 Carlson et al.
9,115,833 B2 8/2015 Crompton et al.
9,149,697 B2 10/2015 Epling et al.

(56) References Cited

U.S. PATENT DOCUMENTS

| | | | |
|---|---|---|---|
| 9,242,156 | B2 | 1/2016 | Goodwin et al. |
| 9,265,999 | B2 | 2/2016 | Vito et al. |
| 9,308,424 | B2 | 4/2016 | Thurman et al. |
| 9,387,382 | B2 | 7/2016 | Long |
| 9,457,248 | B2 | 10/2016 | Long et al. |
| 9,486,680 | B2 | 11/2016 | Burger et al. |
| 9,511,267 | B2 | 12/2016 | Thurman et al. |
| 9,669,277 | B1 | 6/2017 | Haas et al. |
| 10,245,488 | B1 | 4/2019 | Kays et al. |
| 2003/0148836 | A1 | 8/2003 | Falone et al. |
| 2003/0195066 | A1 | 10/2003 | Eggiman |
| 2004/0048701 | A1 | 3/2004 | Falone et al. |
| 2004/0053716 | A1 | 3/2004 | Wu et al. |
| 2005/0070384 | A1 | 3/2005 | Fitzgerald et al. |
| 2006/0025251 | A1 | 2/2006 | Giannetti et al. |
| 2006/0293129 | A1 | 12/2006 | Kobayashi et al. |
| 2007/0155546 | A1 | 7/2007 | Chauvin et al. |
| 2007/0219027 | A1 | 9/2007 | Chong et al. |
| 2008/0070726 | A1 | 3/2008 | Watari et al. |
| 2009/0029810 | A1 | 1/2009 | Fitzgerald et al. |
| 2009/0215560 | A1 | 8/2009 | McNamee et al. |
| 2009/0280934 | A1 | 11/2009 | Watari et al. |
| 2009/0280935 | A1 | 11/2009 | Watari et al. |
| 2010/0113194 | A1 | 5/2010 | Tokieda |
| 2011/0098141 | A1 | 4/2011 | Burger |
| 2011/0195808 | A1 | 8/2011 | Chauvin et al. |
| 2012/0108371 | A1 | 5/2012 | Epling et al. |
| 2014/0080641 | A1 | 3/2014 | Epling et al. |
| 2014/0080642 | A1 | 3/2014 | Epling et al. |
| 2014/0272245 | A1 | 9/2014 | Livingston-Peters et al. |
| 2015/0040349 | A1 | 2/2015 | Malia et al. |
| 2015/0157908 | A1 | 6/2015 | Van Nguyen et al. |
| 2017/0340935 | A1 | 11/2017 | Gray et al. |
| 2019/0143185 | A1 | 5/2019 | Hunt et al. |
| 2019/0290980 | A1 | 9/2019 | Douglas et al. |
| 2019/0344140 | A1 | 11/2019 | Chauvin et al. |

OTHER PUBLICATIONS

Composites World, "Carbon-Kevlar Hinge, Besting metal hardware in weight, thickness, 3X load capacity and 1 million fatigue cycles", available at https://www.compositesworld.com/blog/post/carbon-kevlar-hinge-. Oct. 30, 2017. 5 pages.

European Space Agency , "Passive Damped Deployment of Full Composite Structures", available at http://www.esa.int/Our_Activities/Space_Engineering_Technology/Shaping_the_Future/Passive _Damped_Deployment_of_Full_Composite_Structures, exact publication date unknown website visited Feb. 9, 2018.

Grainger, Inc. , ""1/2"-14 Brass Hydraulic Coupler Body, 1/2" Body Size"", available at https://www.grainger.com/product/31A959?cm_mmc=PPC:+Google+PLA&s_kwcid=AL!2966!3!50916770997!!!g!82128241917!&ef_id=Wamb7gAAAHQQ3Qhf:20180104235230:s&kwid=productads-adid%5e50916770997-device%5ec-plaid%5e82128241917-sku%5e31A959-adType%5ePLAExact publication date unknown. Website visited Jan. 23, 2018. 2 pages.

Russell, Daniel A., Do Flexible Handle affect the Performance of Baseball or Softball Bats?, Pennsylvania State University, Graduate Program in Acoustics. Last modified Feb. 23, 2007. 9 pages.

Russell, Daniel A., "Measuring the Vibrational Behavior of a Baseball/Softball Bat", Science & Mathematics Department, Kettering University, Flint, MI, available at http://www.acs.psu.edu/drussell/bats/modal.html, exact publication date unknown; website visited Nov. 15, 2017;, 3 pgs.

Russell, Daniel A., "Vibrational Modes of a Baseball Bat", Applied Physics, Kettering University, available at http://www.acs.psu.edu/drussell/bats/batvibes.html, exact publication date unknown; website visited Nov. 15, 2017, 4 pgs.

Tech Briefs , "Locking Mechanism for a Flexible Composite Hinge", available at https://www.techbriefs.com/component/content/article/tb/techbriefs/mechanics-and-machinery/26023. Dec. 1, 2016. 7 pages, Dec. 1, 2016.

Sharkbite Plumbing Solutions, search result for "coupling", available at https://www.sharkbite.com/us/en/search?s=coupling, exact publication date unknown, website visited Dec. 15, 2022.

* cited by examiner

ADJUSTABLE FLEX ROD CONNECTION FOR BALL BATS AND OTHER SPORTS IMPLEMENTS

CROSS-REFERENCE TO RELATED APPLICATION

This application is a continuation of U.S. application Ser. No. 15/935,896, filed Mar. 26, 2018, which is incorporated herein by reference in its entirety.

BACKGROUND

When a player swings a ball bat or other hitting implement, a "whip effect" transfers momentum from the player's body out to the far distal end of the bat or hitting implement. A player taking full advantage of the whip effect can produce high bat speeds at the point of impact with the ball. A flexible bat handle may provide an increased whip effect within the bat itself relative to a less flexible handle, so a more flexible bat handle may provide increased bat speed, but a more flexible bat handle may also decrease overall performance (batted ball speed) due to energy absorbed when the bat flexes during impact.

When a ball bat or other hitting implement strikes a ball or another object, the impact causes waves of vibration in the bat or hitting implement that can transfer through the handle to a player's hands, which is felt as shock or sting. This shock or sting can cause discomfort or injury. A more flexible bat handle may absorb more vibration and shock, resulting in less discomfort, but at a cost of reduced overall performance (batted ball speed). A bat with a stiffer or less flexible bat handle may deliver more energy to a ball, resulting in higher performance (batted ball speed), but a stiffer handle may deliver more shock or vibration to the user's hands.

Some ball bats are made in two or more pieces. Two-piece ball bats are typically constructed by joining a barrel section to a handle section. Existing two-piece ball bats typically exhibit a small amount of flex between the barrel section and the handle section during impact with a ball. This flex between sections may contribute to an increase in bat speed due to an increased whip effect but may decrease overall performance due to energy lost when the bat flexes. Flex in the interface between the barrel section and the handle section of existing two-piece bats may reduce shock to a user's hands and increase player comfort to some extent, but existing two-piece ball bats do not have optimal shock-attenuating characteristics relative to their performance.

In addition, existing ball bats do not offer adjustable or customizable flexibility or other adjustable characteristics. For example, players have varying preferences. A bat that one player prefers may be undesirable to another player, or a given player may prefer some characteristics of a single bat while disliking other characteristics.

SUMMARY

Representative embodiments of the present technology include a ball bat including a barrel portion, a handle portion, a flexible rod element positioned between the barrel portion and the handle portion, a first releasable connector connecting the rod element to the handle portion, and a second releasable connector connecting the rod element to the barrel portion. In some embodiments, the ball bat may include a tether attached to the handle portion and the barrel portion. One or both of the first releasable connector and the second releasable connector may include an inner stud configured to be retained in a sleeve by a slidable ring. The rod element may include an elastomeric material. In some embodiments, the rod element may include a composite material.

Another representative embodiment of the present technology includes a ball bat with a barrel portion, a handle portion, and a joint connecting the handle portion to the barrel portion. The joint may include at least one releasable connector configured to releasably connect the barrel portion to the handle portion. The releasable connector may include a threaded connection configured to resist release of the releasable connector. In some embodiments, the ball bat may include an external safety connector connecting the barrel portion to the handle portion.

Another representative embodiment of the present technology includes a ball bat with a barrel portion, a handle portion, and a means for adjusting flex between the barrel portion and the handle portion. In some embodiments, the means for adjusting flex may include a releasable connector configured to releasably connect the barrel portion to the handle portion. In some embodiments, the means for adjusting flex may include two releasable connectors configured to releasably connect the barrel portion to the handle portion. The means for adjusting flex may include a removable rod element, which may include an elastomeric material. An external safety connector may also connect the barrel portion to the handle portion.

In some embodiments, the means for adjusting flex includes a rotatable collar positioned between the barrel portion and the handle portion, and a threaded flexible rod element positioned inside the rotatable collar.

In some embodiments, the means for adjusting flex may include a rotatable cylinder attached to the handle portion, a tapered plunger positioned in the barrel portion, and a threaded rod connecting the rotatable cylinder or the handle portion to the tapered plunger. The threaded rod is configured to rotate to move the tapered plunger within the barrel portion.

Ball bats and hitting implements according to embodiments of the present technology provide an enhanced connection between portions of the bat (such as between a barrel portion and the handle portion) to reduce shock and vibration felt by a player during the bat's impact with a ball and to tailor the whip effect of the bat. Ball bats and hitting implements according to the present technology may also provide interchangeable components for connecting handles with barrels to allow customization of shock reduction, vibration reduction, or flex in the bat or hitting implement.

Other features and advantages will appear hereinafter. The features described above can be used separately or together, or in various combinations of one or more of them.

BRIEF DESCRIPTION OF THE DRAWINGS

In the drawings, wherein the same reference number indicates the same element throughout the several views.

DETAILED DESCRIPTION

The present technology is directed to adjustable flex rod connections for ball bats and other sports implements, and to ball bats with adjustable flex rod connections, as well as associated systems and methods. Various embodiments of the technology will now be described. The following description provides specific details for a thorough understanding and enabling description of these embodiments. One skilled in the art will understand, however, that the invention may be practiced without many of these details. Additionally, some well-known structures or functions, such as those common to ball bats and composite materials may not be shown or described in detail so as to avoid unnecessarily obscuring the relevant description of the various embodiments. Accordingly, embodiments of the present technology may include additional elements or exclude some of the elements described below with reference to FIGS. 1-11, which illustrate examples of the technology.

The terminology used in this description is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list. Further, unless otherwise specified, terms such as "attached" or "connected" are intended to include integral connections, as well as connections between physically separate components.

Specific details of several embodiments of the present technology are described herein with reference to baseball or softball. The technology may also be used in other sporting good implements or in other sports or industries involving striking, hitting, or swinging implements.

Figure 1:
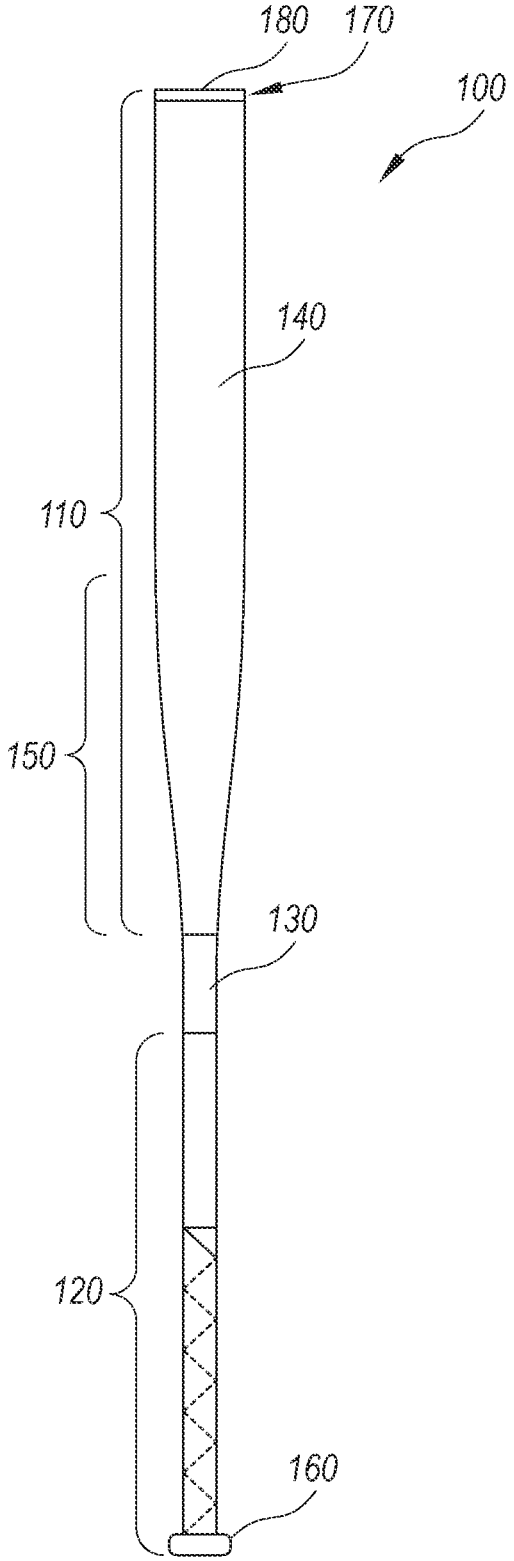
FIG. 1 illustrates a two-piece ball bat having a barrel portion connected to a handle portion via a joint with a flex rod connection according to an embodiment of the present technology.

As shown in FIG. 1, a two-piece ball bat 100 according to an embodiment of the present technology may have a first or barrel portion 110 connected to a second or handle portion 120 via a joint 130. The barrel portion 110 includes a barrel 140 and a transitional or taper portion 150 in which a larger diameter of the barrel 140 transitions toward a narrower diameter of the joint 130 and the handle portion 120. The handle portion 120 may include an end knob 160, and the barrel 140 may optionally be closed at its distal end 170 (the end farthest from a player during the swing) with an end cap 180.

The bat 100 may have any suitable dimensions. For example, the bat 100 may have an overall length of 20 to 40 inches, or 26 to 34 inches. The overall barrel diameter may be 2.0 to 3.0 inches, or 2.25 to 2.75 inches. Typical ball bats have diameters of 2.25, 2.625, or 2.75 inches. Bats having various combinations of these overall lengths and barrel diameters, or any other suitable dimensions, are contemplated herein. The specific preferred combination of bat dimensions is generally dictated by the user of the bat 100, and may vary greatly among users. Among other advantages described herein, the present technology allows a user to reconfigure dimensions of the bat 100 by replacing parts such as the barrel portion 110, the handle portion 120, and portions of the joint 130.

Although the bat 100 is described herein as a "two-piece" bat, it is understood that the nomenclature "two-piece" merely generally refers to the construction of a bat in which the barrel portion (e.g., barrel portion 110) and the handle portion (e.g., handle portion 120) are not integral. Indeed, the bat 100 may have more than two pieces. For example, each of the barrel portion 110 and the handle portion 120 may be formed using multiple pieces, portions, or elements. Moreover, although the joint 130 is illustrated and described as being between the handle 120 and the taper portion 150, in some embodiments of the present technology, the joint 130 may be positioned in the taper portion 150, such that each of the barrel portion 110 and the handle portion 120 include part of the taper portion 150, or the joint 130 forms part of the taper portion 150. In other embodiments, the joint 130 may be located entirely in the handle portion 120, or entirely in the barrel portion 110. In some embodiments, the handle 120 may include the taper portion 150, such that the joint 130 is between the taper portion 150 and the barrel 140.

As will be described in detail below, joints 130 according to embodiments of the present technology provide an interchangeable or adjustable interface between various barrel portions 110 and handle portions 120 for a customizable bat. For example, the joint 130 may exhibit varying levels of flex and durability, and it may connect various configurations of barrel portions 110 and handle portions 120 formed with various materials.

In some embodiments, joints 130 can disconnect from both the barrel portion 110 and the handle portion 120 to allow a user to replace one or more components of the joint 130 (for example, to incorporate a more or less flexible joint) while using the same barrel portion 110 and handle portion 120. In some embodiments, a user can remove the barrel portion 110 or the handle portion 120 from a bat 100 and replace the removed portion with a different portion having different characteristics. For example, a user or manufacturer can customize swing weight, size, or barrel performance features (e.g., ball-bat coefficient of restitution, known as BBCOR). In some embodiments, a joint 130 may be permanently or semi-permanently attached at one end to either the barrel portion 110 or the handle portion 120, while the other portion of the bat 100 may be removed and replaced at the other end of the joint 130.

Accordingly, in some embodiments, the joint 130 may be in the form of a connection to allow a barrel portion 110 and a handle portion 120 to be easily separated and replaced with other barrel or handle portions, or the joint 130 itself may be replaced or modified. In some embodiments, a bat 100 may be manufactured or sold as modular components (a modular ball bat) or a kit of parts including one or more of the barrel portion 110, the handle portion 120, or the joint 130.

In some embodiments, joints 130 may be permanently or semi-permanently attached to both the barrel portion 110 and the handle portion 120. Such permanently attached embodiments may include an adjustable joint 130, as described in further detail below.

In some embodiments, the barrel portion 110 may be constructed with one or more composite materials. Some examples of suitable composite materials include plies reinforced with fibers of carbon, glass, graphite, boron, aramid (such as Kevlar®), ceramic, or silica (such as Astroquartz®). Accordingly, in various embodiments, a number of different composite plies suitable for use in ball bats may be used, including, for example, composites formed from carbon fiber, fiberglass, aramid fibers, or other composite materials or combinations of matrices, resins, fibers, laminates, and meshes forming composite materials. In some embodiments, the barrel portion 110 may include layers or plies made of the same material (for example, each ply or layer may be formed from carbon fiber), while in other embodiments, the barrel portion 110 may include layers or plies made of multiple different materials (for example, one or more plies or layers may be formed with carbon fiber and one or more other plies or layers may be formed with fiberglass). In some embodiments, the barrel portion 110 may be formed from a metal or metal alloy, such as aluminum, titanium, or another suitable metal. In yet further embodiments, the barrel portion 110 may be formed with wood.

The handle portion 120 may be constructed from the same material as, or different materials than, the barrel portion 110. For example, the handle portion 120 may be constructed from a composite material (the same or a different material than that used to construct the barrel portion 110), a metal material, a wood material, or any other material suitable for use in a striking implement such as the bat 100.

In a representative example, the barrel portion 110 and the handle portion 120 may each be formed from a metal or metal alloy (the same or different metal or metal alloy as each other). In another representative example, one of the barrel portion 110 or the handle portion 120 may be formed with a composite material while the other of the barrel portion 110 or the handle portion 120 may be formed with a different material, such as metal or wood. A user or manufacturer may choose the materials and properties for the barrel portion 110, handle portion 120, and joint 130 to achieve a desired level of flex, performance, swing weight, durability, or shock absorption, among other characteristics.

Figure 2:
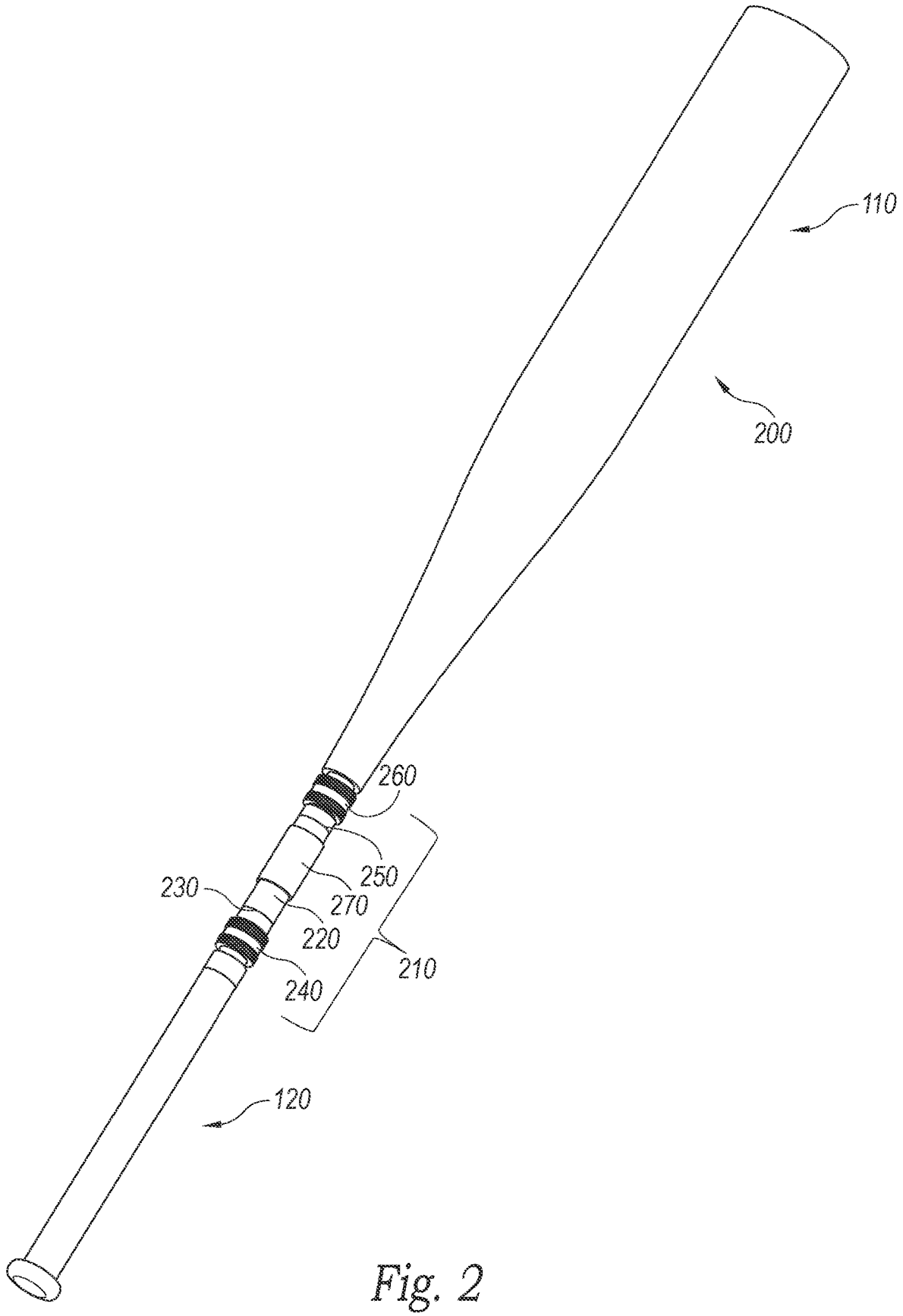
FIG. 2 illustrates a bat with a joint having a flex rod connection and two releasable connectors to connect a barrel portion and a handle portion according to an embodiment of the present technology.

FIG. 2 illustrates a bat 200 having a joint 210 connecting a barrel portion 110 to a handle portion 120 according to an embodiment of the present technology. The joint 210 includes a flexible rod element or flex rod 220 that is permanently or semi-permanently connected at a first end 230 to a first releasable connector 240. The first releasable connector 240 is permanently or semi-permanently attached to the handle portion 120 (using adhesive or a mechanical connection such as a threaded, pinned, or welded connection, or another suitable connection). The flex rod 220 is permanently or semi-permanently connected at a second end 250 to a second releasable connector 260, which is permanently or semi-permanently attached to the barrel portion 110 (using adhesive or a mechanical connection such as a threaded, pinned, or welded connection, or another suitable connection).

Each of the first releasable connector 240 and the second releasable connector 260 is a mechanism that allows connected parts to be separated. For example, the first releasable connector 240 allows the flex rod 220 to be separated from and rejoined to the handle portion 120 or another handle portion. The second releasable connector 260 allows the flex rod 220 to be separated from and rejoined to the barrel portion 110 or another barrel portion. Accordingly, the bat 200 can be disassembled into multiple segments, including the barrel portion 110, the handle portion 120, and the flex rod 220 (with permanently or semi-permanently attached portions of the releasable connectors 240, 260). Each releasable connector 240, 260 may be any suitable mechanism capable of releasably connecting two shafts together (such as the handle and flex rod, or the flex rod and barrel).

FIG. 2 also illustrates an optional wrapping 270 around the flex rod 220. The wrapping 270 may include decoration, indicia, or it may add thickness to the appearance of the joint 210 to increase the appearance of continuity between the shape of the barrel portion 110 and the handle portion 120.

Figure 3:
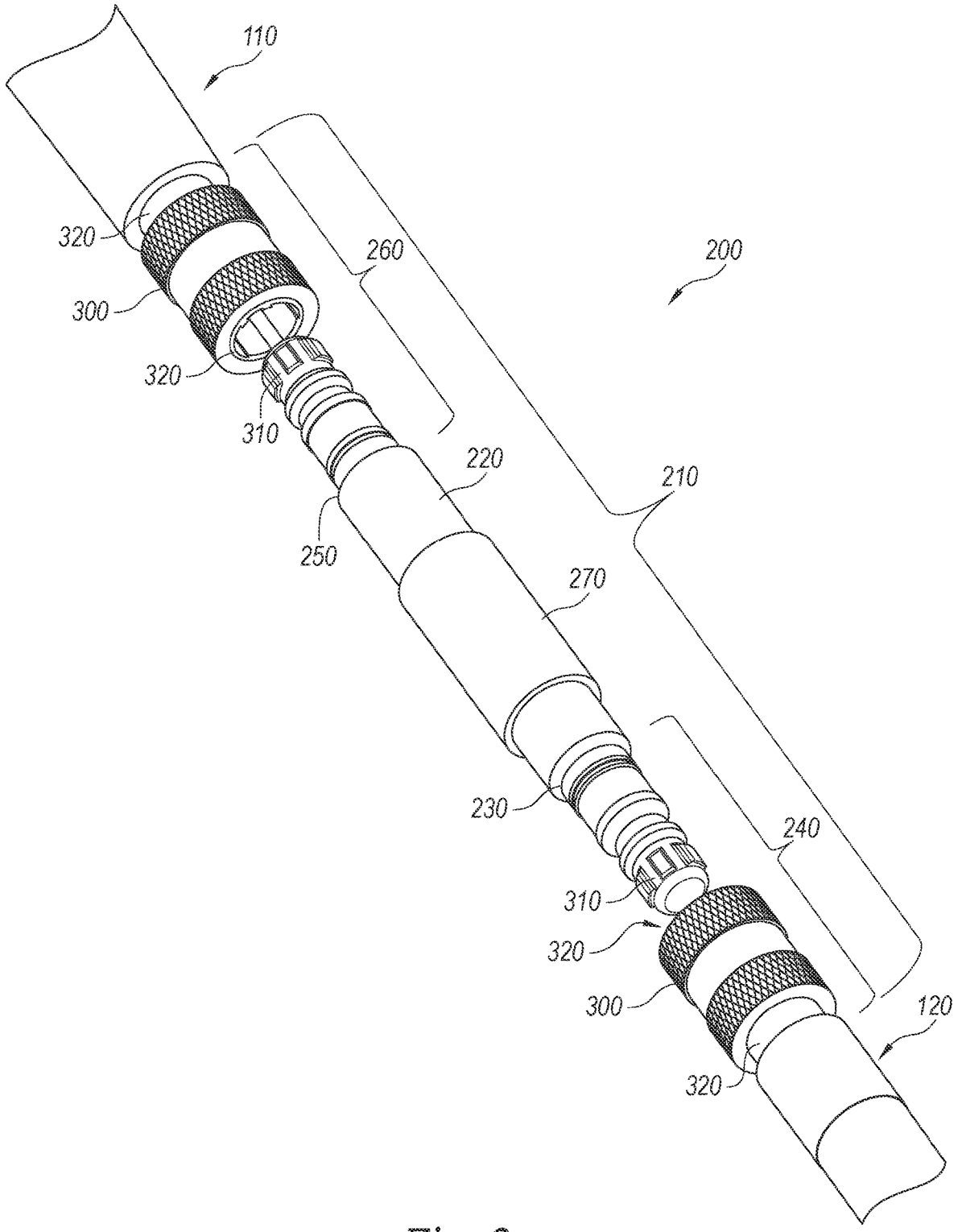
FIG. 3 illustrates an exploded view of a portion of the bat illustrated in FIG. 2, showing a joint with a flex rod connection.

FIG. 3 illustrates an exploded view of a portion of the bat 200 shown in FIG. 2, to show the operation of representative releasable connectors 240, 260. FIG. 3 illustrates the flex rod 220 removed from the barrel portion 110 and the handle portion 120 after releasing the releasable connectors 240, 260. In some embodiments, a male portion or inner stud 310 of the releasable connector may be permanently or semi-permanently attached to each of the first end 230 and the second end 250 of the flex rod 220 (using adhesive or a mechanical connection such as a threaded or welded connection, or another suitable connection). A sleeve 320 may be permanently or semi-permanently attached to each of the barrel portion 110 and the handle portion 120 (using adhesive or a mechanical connection such as a threaded, pinned, or welded connection, or another suitable connection). A slidable retaining ring 300 may be slidably mounted on each sleeve 320 and spring-biased toward its corresponding inner stud 310 to keep the inner stud 310 engaged in the sleeve 320. For example, a spring-loaded bearing may be positioned in the slidable retaining ring 300 to lock the inner stud 310 in the sleeve 320.

A user can slide the ring 300 away from the flex rod 220 to release the corresponding stud 310 to separate the barrel portion 110 from the flex rod 220, or the handle portion 120 from the flex rod 220. In some embodiments, the orientation of the releasable connectors 240, 260 may be reversed, such that the male portion or inner stud 310 is attached to the corresponding barrel portion 110 or handle portion 120, while the slidable ring 300 and the sleeve 320 are attached to the flex rod 220.

In some embodiments, the releasable connectors 240, 260 may be similar to connection devices used in various industries to releasably connect pipes and shafts. For example, in some embodiments, the releasable connectors 240, 260 may be similar to push-fit pipe couplings known in the plumbing or hydraulics industry. In other embodiments, other devices suitable for connecting shafts together to resist being pulled apart may be used. For example, in some embodiments, clamps or other fasteners may be used as releasable connectors 240, 260.

Figure 4:
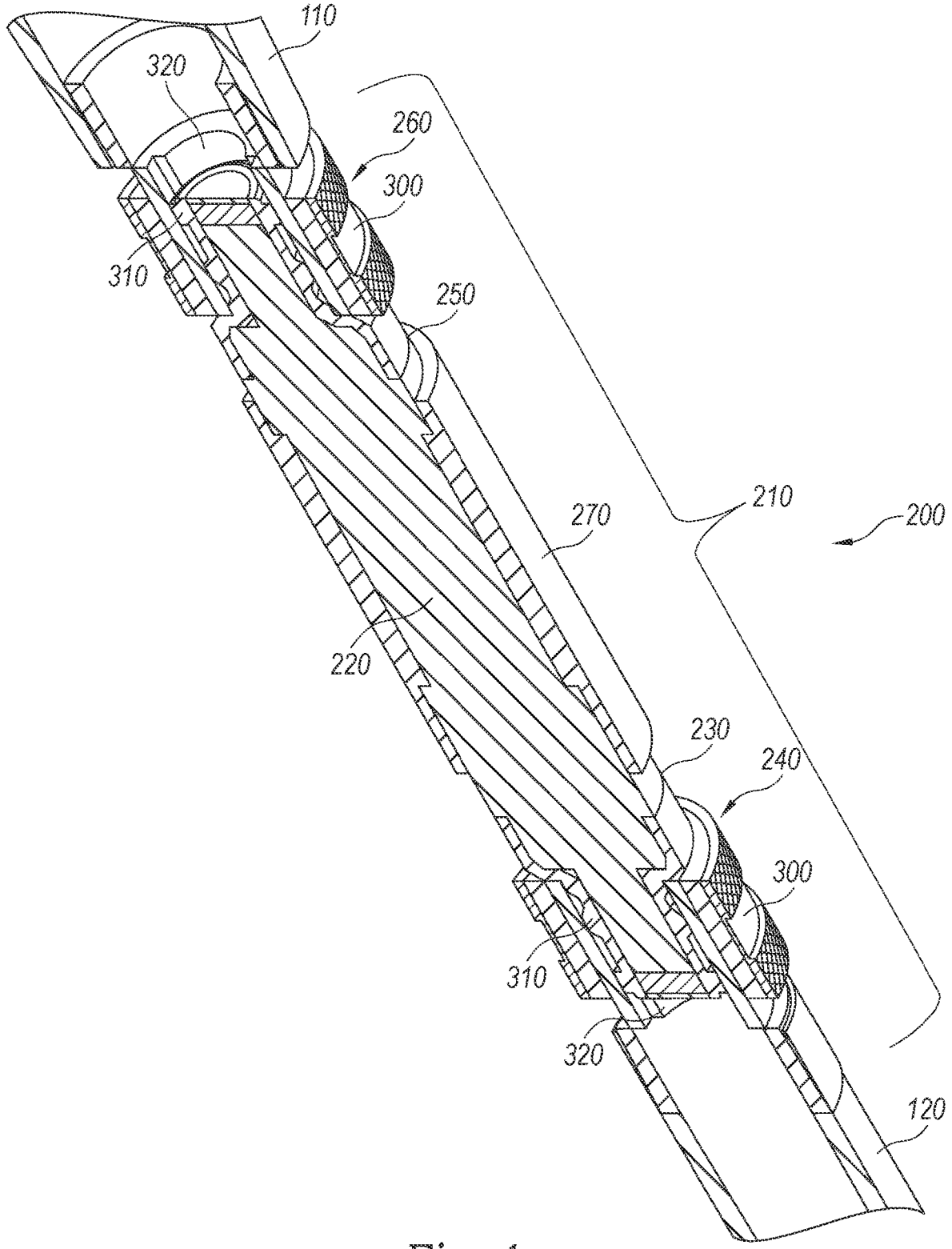
FIG. 4 illustrates a cross-sectional view of the portion of the bat shown in FIG. 3, in an assembled configuration.

FIG. 4 illustrates a cross-sectional view of the portion of the bat 200 shown in FIG. 3, in an assembled configuration. The flex rod 220 may be formed from one or more suitable materials for providing desired flexibility and durability. For example, in some embodiments, the flex rod 220 may be formed from one or more of a metal material (such as aluminum, steel, magnesium, titanium, beryllium copper, or any other metal material mentioned herein), a composite material (such as carbon fiber in an epoxy or polyurethane matrix, glass fiber in an epoxy or polyurethane matrix, quartz fibers in an epoxy or polyurethane matrix, aramid fibers such as KEVLAR® in an epoxy or polyurethane matrix, polypropylene fibers such as INNEGRA® in an epoxy or polyurethane matrix, or any composite material mentioned herein), a plastic material (such as nylon or other plastic materials), a wood material, or an elastomeric material (such as thermoplastic urethane or rubber).

In a particular representative embodiment, the flex rod 220 may be formed as a solid composite rod. In another particular representative example, the flex rod 220 may be a fiber-reinforced plastic rod. In some embodiments, the flex rod 220 may be hollow, or it may have a number of through-holes, or it may be solid. In some embodiments, the flex rod 220 may be round or cylindrical, while in other embodiments it may have other cross-sectional shapes, such as a polygonal shape. In some embodiments, the flex rod 220 may have a varying shape along its length or it may taper along its length. The shape, size, and material of the flex rod 220 may be selected to provide the desired amount of flex in the joint 210.

The flex rod 220 provides at least some of the flexibility in the joint 210 that absorbs shock from the bat's impact with a ball or it provides a customized whip effect during the swing. In some embodiments, the flex rod may be only slightly flexible or it may be generally inflexible or stiff. In some embodiments, one or both of the releasable connectors 240, 260 may be omitted and replaced with a permanent connector.

As described in additional detail above, embodiments of the present technology provide a modular and customizable bat in which a user or manufacturer may select various materials for the flex rod 220, the barrel portion 110, and the handle portion 120 to customize the whip effect, flexibility, swing weight, durability, performance (such as BBCOR), and shock absorption characteristics of the bat 200, among other characteristics. For example, various flex and damping characteristics may be facilitated by material selection and the type of connection. A flex rod made with a relatively flexible material such as fiberglass or plastic may result in more flex, and therefore, more whip effect and lower vibration transfer through the joint. A flex rod made with a more stiff material such as carbon fiber or titanium may facilitate a more stiff bat feel, resulting in less whip effect and more vibration transfer through the joint. A flex rod made with a combination of materials, such as fiberglass and carbon fiber, or a more ductile metal like steel or aluminum, may facilitate a whip effect and vibration feel similar to a bat that does not have joints according to the present technology. Ball bats according to the present technology allow for rapid modification of bat characteristics, even during an inning between uses. They also facilitate easy transportation because they may be disassembled into their constituent parts. A player can select the desired whip effect and vibration for a given sport (e.g., slow pitch softball, fast pitch softball, or baseball).

In order to comply with sports association rules and to further improve safety, the releasable connectors 240, 260 may be designed or selected to resist accidental or undesired release. In some embodiments of the present technology, redundant safety features may be incorporated to keep the barrel portion 110 from completely separating from the handle portion 120 when such separation is not desired.

Figure 5:
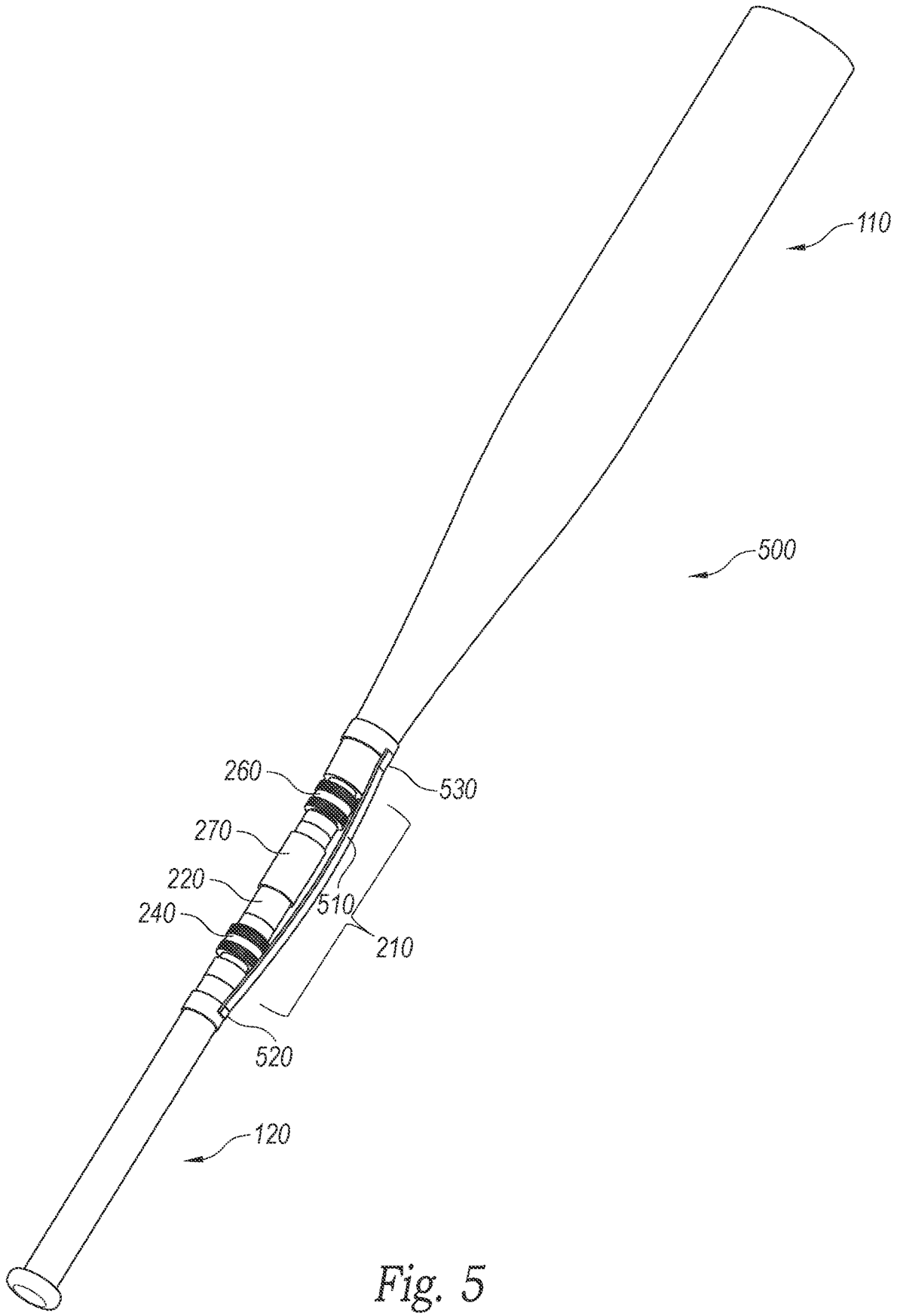
FIG. 5 illustrates a bat similar to the bat shown in FIGS. 2-4 and further includes an external safety connector, according to another embodiment of the present technology.

For example, FIG. 5 illustrates a bat 500 that is similar to the bat 200 illustrated in FIGS. 2-4, but that further includes an external safety connector 510. The external safety connector 510 may be permanently or semi-permanently attached at a first end 520 to the handle portion 120, and it may be permanently or semi-permanently attached at a second end 530 to the barrel portion 110. In some embodiments, as illustrated in FIG. 5, the external safety connector 510 may be a tether or a strap that prevents the barrel portion 110 and the handle portion 120 from completely separating if the joint 210 breaks or otherwise releases due to, for example, user error in assembling the components or wear or abuse. The tether may be made of a flexible material having high strength, such as nylon rope or webbing, aramid rope or webbing, steel wire or rope, or polypropylene webbing or tape, or other suitable materials. The tether may be inserted into a slot on the bat body or locked into the bat by threading through other parts.

The external safety connector 510 may be glued, fastened with fasteners, embedded, or otherwise suitably attached to the barrel portion 110 and the handle portion 120. The external safety connector 510 may be made of any suitable material, including soft or hard materials, such as cloth, rope, plastic, metal, or other materials with suitable tensile strength. Although FIG. 5 illustrates an external safety connector, in some embodiments, the safety connector may be positioned inside of the joint 210. For example, the safety connector may pass through the joint components 210, including the flex rod 220, and connect the barrel portion 110 to the handle portion 120 in a manner that is not visible when the bat is assembled.

In some embodiments, other safety devices may be included to prevent component parts from separating during use. The releasable connectors 240, 260 may include threaded portions (such as the threaded portion described below with regard to FIG. 7) or locking pins or other devices to prevent them from releasing accidentally. In some embodiments, one or both of the releasable connectors 240, 260 may be designed such that if they are connected improperly they disengage too easily to even allow a user to hold the bat in one piece.

Figure 6:
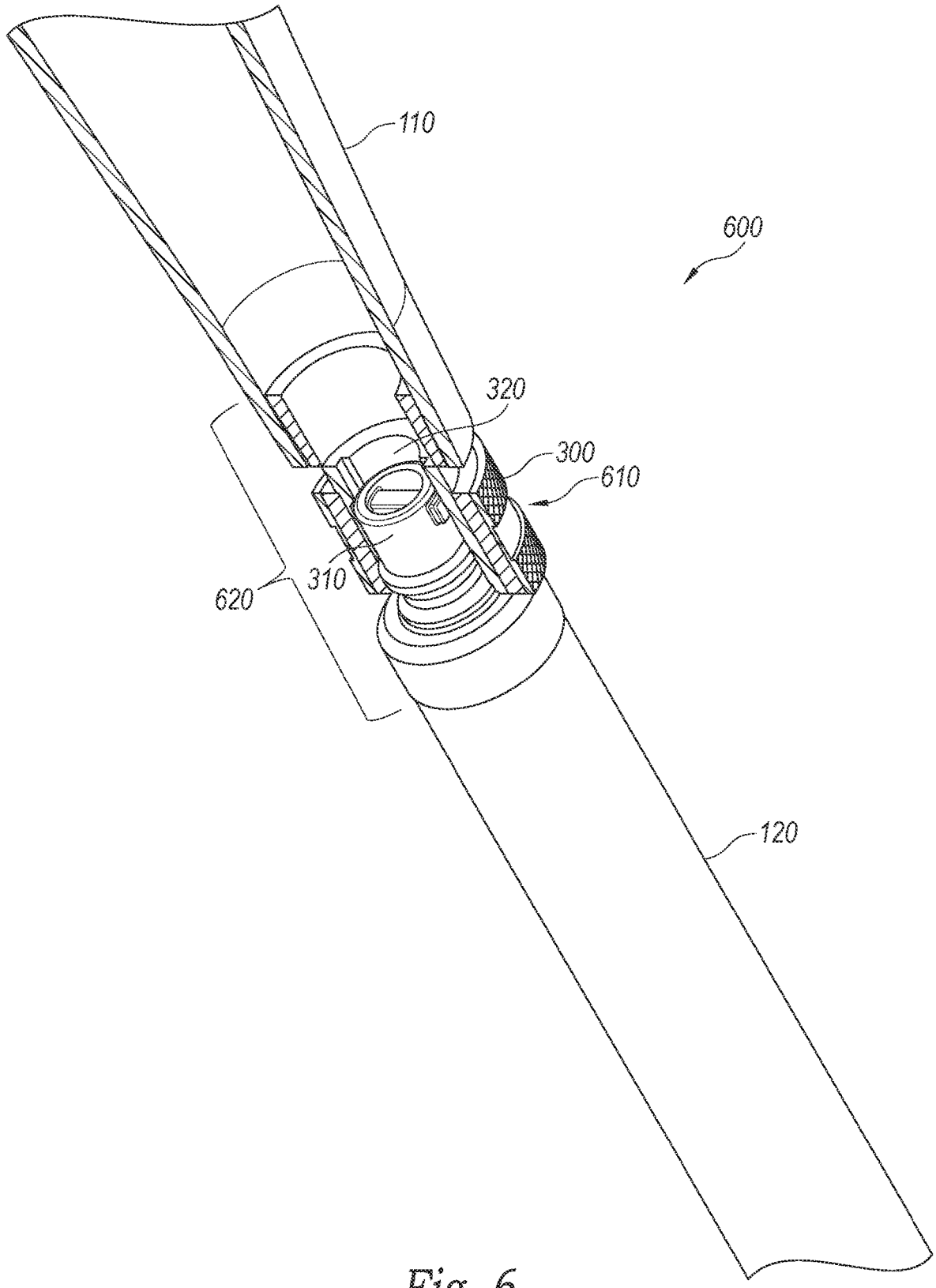
FIG. 6 illustrates a bat in accordance with another embodiment of the present technology, in which a single releasable connector connects the barrel portion to the handle portion.

FIG. 6 illustrates a bat 600 in accordance with another embodiment of the present technology, in which a single releasable connector 610 connects the barrel portion 110 to the handle portion 120 in the joint 620. The releasable connector 610 may be similar to the releasable connectors (240, 260) described above with regard to FIGS. 2-5. For example, a male portion or inner stud 310 may be permanently or semi-permanently attached to the handle portion 120 (using adhesive or a mechanical connection such as a threaded, pinned, or welded connection, or another suitable connection). A sleeve 320 may be permanently or semi-permanently attached to the barrel portion 110 (using adhesive or a mechanical connection such as a threaded, pinned, or welded connection, or another suitable connection). The slidable retaining ring 300 may be slidably mounted on the sleeve 320 and spring-biased toward the inner stud 310 to keep the inner stud 310 engaged in the sleeve 320. A user can slide the ring 300 toward the barrel portion 110 to release the stud 310 and separate the barrel portion 110 from the handle portion 120. In some embodiments, for example, the releasable connector 610 may be similar to a pipe or hydraulic fitting.

In some embodiments, the orientation of the releasable connector 610 may be reversed, such that the male portion or inner stud 310 is attached to the barrel portion 110, while the slidable ring 300 and the sleeve 320 are attached to the handle portion 120. In yet further embodiments, an external or internal safety connector can secure the barrel portion 110 to the handle portion 120 (similar to the safety connectors described above with regard to FIG. 5) to reduce the risk of accidental total separation.

In some embodiments, the handle portion 120 may exhibit a particular amount of flex to provide a particular level of shock absorption or whip effect (thereby having a similar function as the flex rod 220 described above with regard to FIGS. 2-5). A user may disconnect the barrel portion 110 from the handle portion 120 and replace one or the other with another portion having desirable characteristics depending on the player's preference, ability, or the style of play. For example, a user can select a relatively flexible handle portion 120 to mate with a high performance (high BBCOR) barrel portion 110, or a user can select other suitable configurations, such as the other combinations of barrels and handles described above. In a specific example, a player in slow-pitch softball may desire a more flexible handle, while a player in fast-pitch softball or baseball may desire a stiffer handle.

Figure 7:
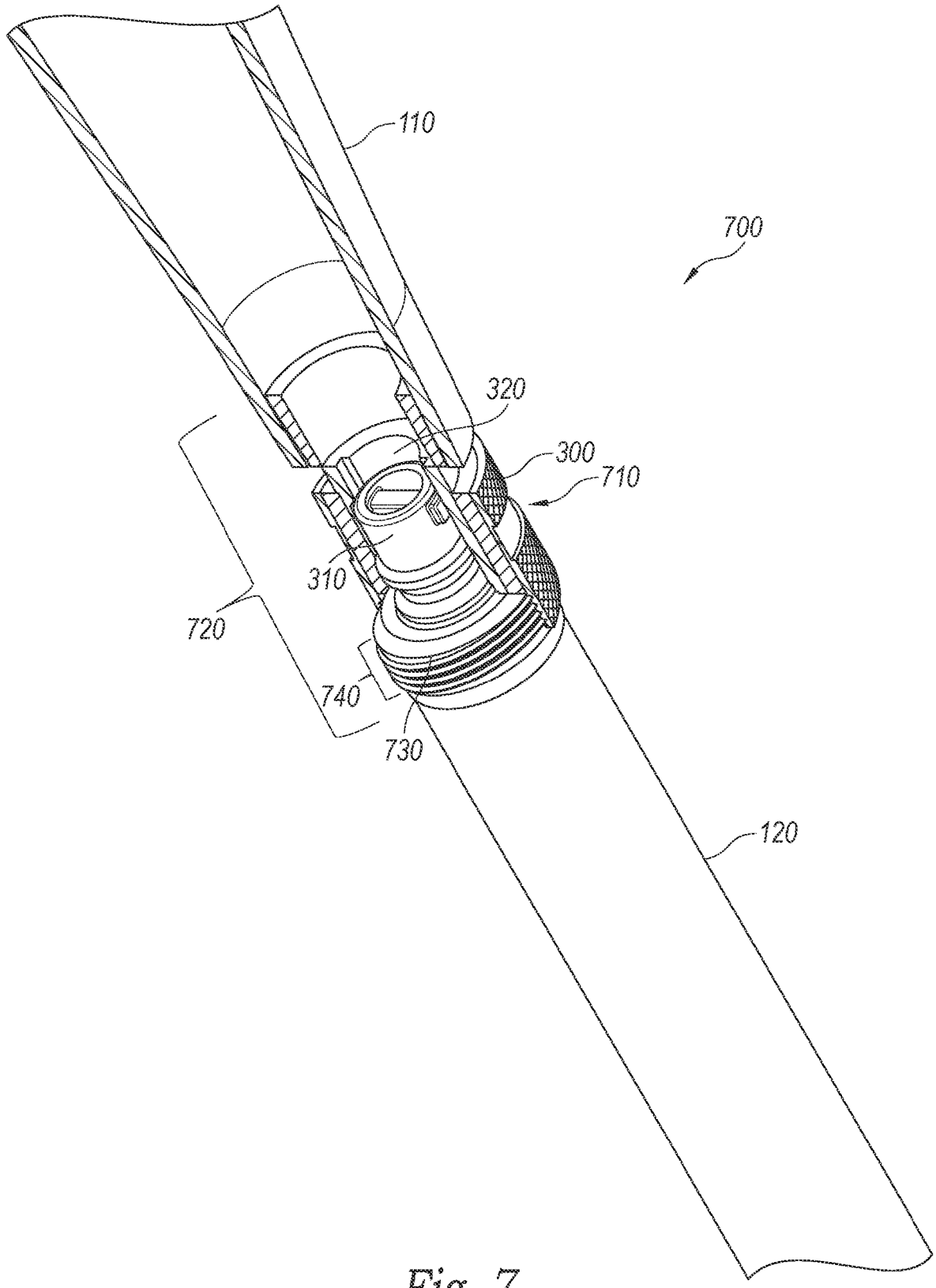
FIG. 7 illustrates a bat in accordance with another embodiment of the present technology, which is similar to the bat shown in FIG. 6, and further includes a threaded safety feature.

FIG. 7 illustrates a bat 700 in accordance with another embodiment of the present technology, which is similar to the bat 600 described above with regard to FIG. 6, while further including a threaded safety feature. Specifically, the bat 700 may include a releasable connector 710 that connects the barrel portion 110 to the handle portion 120 in the joint 720. The releasable connector 710 may be similar to the releasable connector 610 described above with regard to FIG. 6, but it may further include a threaded connection 730 between the ring 300 and the base 740 of the inner stud 310. In operation, a user can rotate the ring 300 to engage the threaded connection 730 so the ring 300 cannot be pulled away from the inner stud 310, thereby preventing the joint 720 from accidentally releasing. The threaded connection 730 may also be implemented in other embodiments, such as embodiments with multiple releasable connectors like the one described above with regard to FIGS. 2-5.

Figure 8:
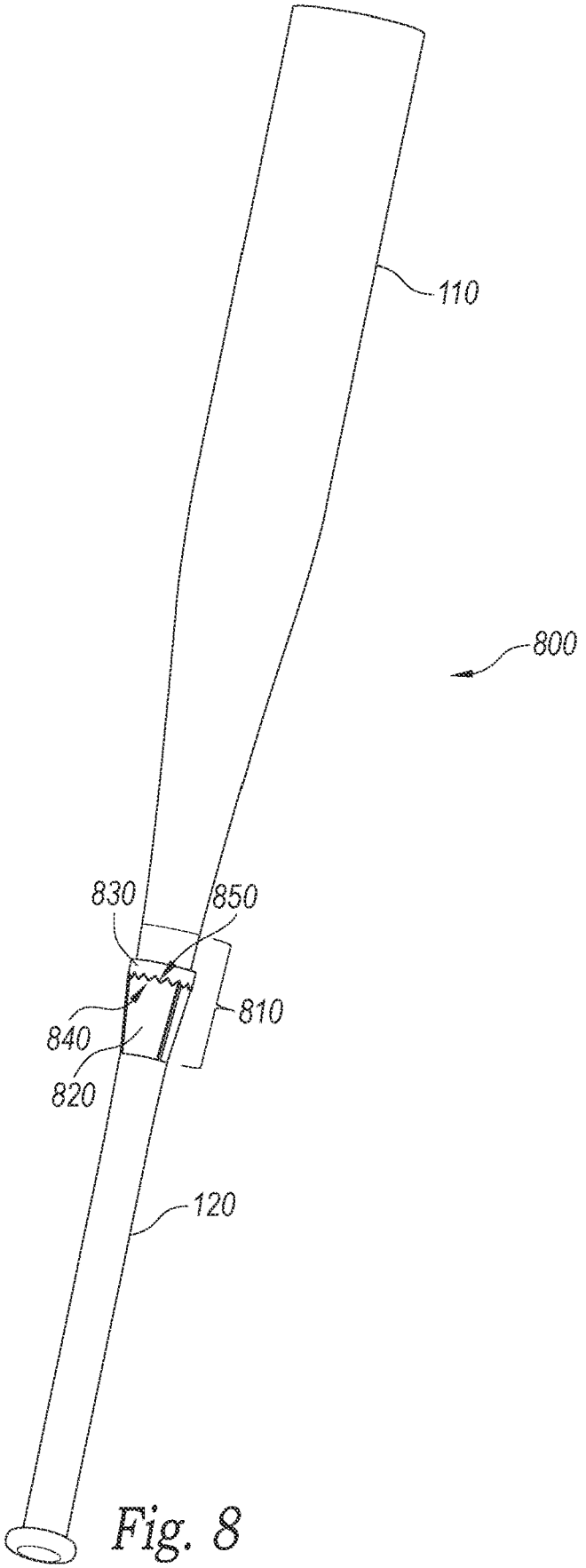
FIG. 8 illustrates a two-piece ball bat having a barrel portion connected to a handle portion via an adjustable joint according to another embodiment of the present technology.

FIG. 8 illustrates a two-piece ball bat 800 having a barrel portion 110 connected to a handle portion 120 via a joint 810 according to another embodiment of the present technology. The joint 810 includes a rotatable cylinder 820 (which may be in the form of a tapered cylinder or cone, as shown in FIG. 8) connected to the handle portion 120, and a collar 830 connected to the barrel portion 110. The rotatable cylinder 820 includes teeth 840 around a circumferential edge adjacent to corresponding teeth 850 circumferentially arranged around the collar 830. When the teeth 840, 850 are engaged with each other, as illustrated in FIG. 8, they prevent relative rotation between the rotatable cylinder 820 and the collar 830. The collar 830 can translate along the longitudinal axis of the bat 800 away from the handle portion 120 to disengage the teeth 840, 850 from each other. When the collar 830 is pulled away from the rotatable cylinder 820, and the teeth 840, 850 are disengaged from each other, the rotatable cylinder 820 and the handle portion 120 can be rotated relative to the barrel portion 110 to tighten or loosen an interior mechanism (described in further detail below) that adjusts the flex between the barrel portion 110 and the handle portion 120. The collar 830 may be spring-loaded to be biased toward the rotatable cylinder 820 to maintain engagement between the teeth 840, 850.

Figure 9:
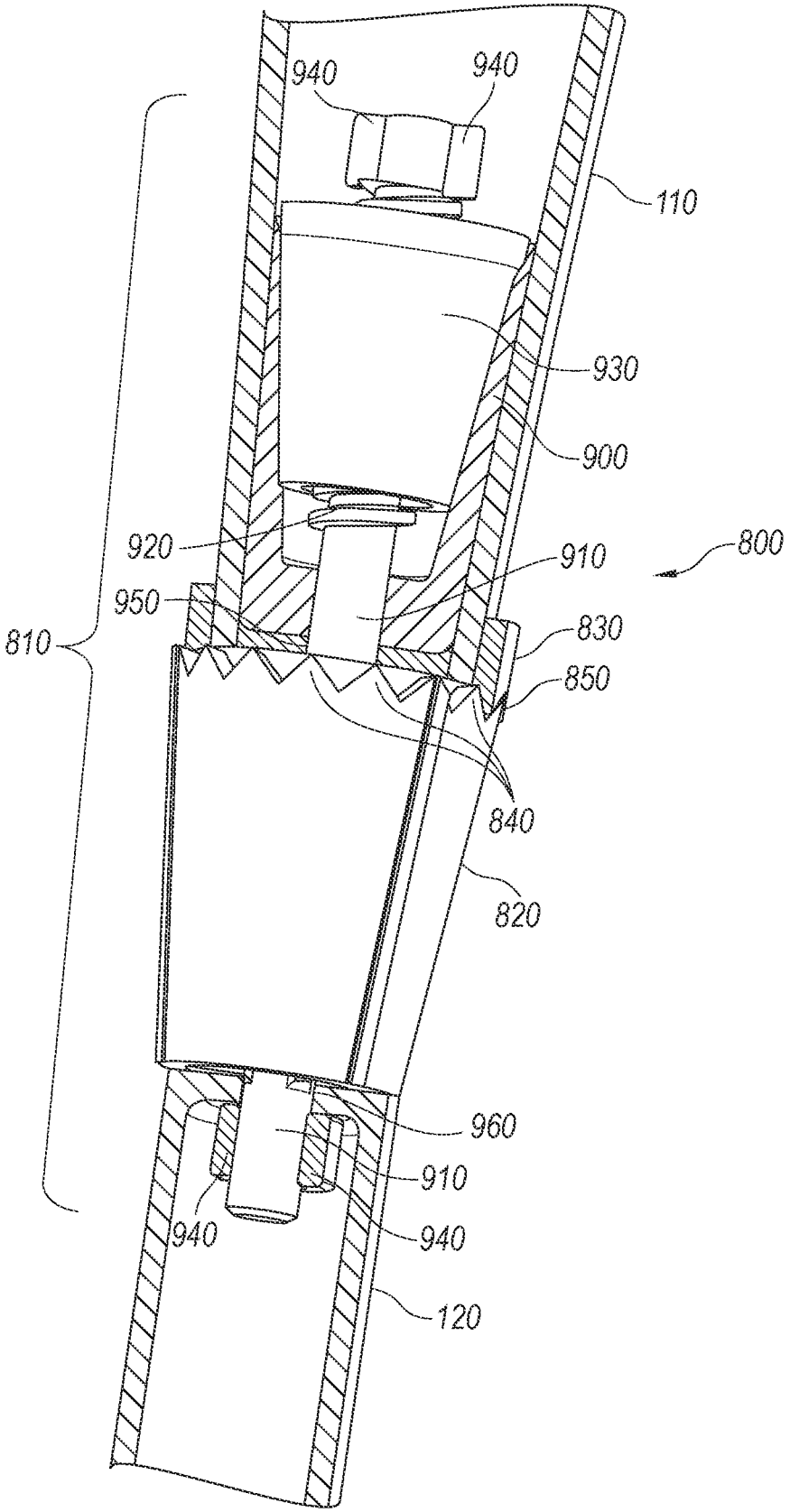
FIG. 9 is a partial cross-sectional view of a portion of the bat and the joint shown in FIG. 8.

FIG. 9 is a partial cross-sectional view of a portion of the bat 800 and the joint 810 shown in FIG. 8, illustrating the interior mechanism that facilitates adjustment of the flex between the barrel portion 110 and the handle portion 120. A cup 900 is positioned inside the barrel portion 110. In some embodiments, the cup 900 may be integrally formed with the barrel portion 110, or it may be a separate element installed in the barrel portion 110. The rotatable cylinder 820 and the handle portion 120 are connected to a threaded rod 910, which extends into the barrel portion 110 and connects to a tapered plunger 930 positioned in the cup 900.

When the rotatable cylinder 820 is rotated in a first direction, the threaded rod 910 rotates in the first direction, causing threads 920 on the threaded rod 910 to engage corresponding threads 1030 (shown in FIG. 10) in the tapered plunger 930 to draw the tapered plunger 930 deeper into the cup 900 in the barrel portion 110. As the tapered plunger 930 is drawn further into the cup 900, it compresses, which decreases the relative flex between the barrel portion 110 and the handle portion 120. If the rotatable cylinder 820 and the handle portion 120 are rotated in a second direction opposite the first direction, the tapered plunger 930 is pushed in the reverse direction, lessening the compression on the tapered plunger 930 and increasing the relative flex between the barrel portion 110 and the handle portion 120. Accordingly, by rotating the rotatable cylinder 820 and the handle portion 120, a user can adjust the relative flex between the barrel portion 110 and the handle portion 120. In some embodiments, the tapered plunger 930 may be a rubber or elastomeric material. In some embodiments, the cup 900 may be made of a plastic material. In other embodiments, other suitable materials may be used to provide a flexible plunger 930 and cup 900 configured to compress the plunger 930. In some embodiments, the cup 900 or the tapered plunger 930 may be removed and replaced by a user to further adjust or customize the range of flexibility. In some embodiments, the plunger need not be tapered, and it may have other suitable shapes.

One or more flanges 940 on ends of the threaded rod 910 may be sized so that they cannot pass through respective openings in the barrel portion 110 (with opening 950) and the handle portion 120 (with opening 960), thus providing a safety feature to keep the barrel portion 110 and the handle portion 120 from fully separating if the joint 810 has a failure. In some embodiments, the barrel portion 110 and the handle portion 120 can be separated to allow a user to select a different combination of components.

Figure 10:
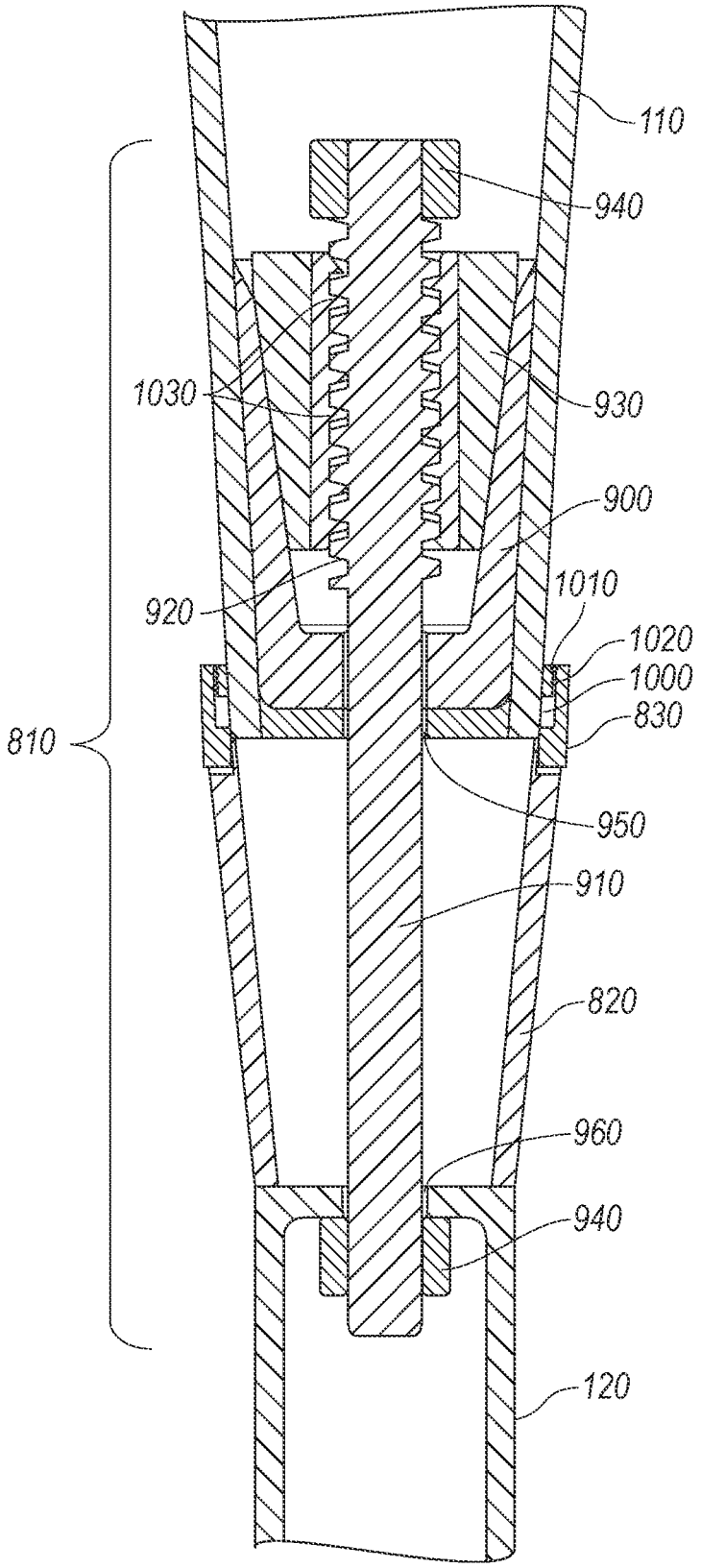
FIG. 10 illustrates another cross-sectional view of the portion of the bat and the joint shown in FIGS. 8 and 9.

FIG. 10 illustrates another cross-sectional view of the portion of the bat 800 and the joint 810 illustrated in FIGS. 8 and 9. In particular, FIG. 10 illustrates the spring-loaded nature of the collar 830. The collar 830 includes a slot 1000 that allows the collar 830 to slide or translate along the longitudinal axis of the barrel portion 110 between the rotatable cylinder 820 and a block or edge 1010 on the barrel portion 110. A spring 1020 may be positioned between the block or edge 1010 and the collar 830 in any location suitable for biasing the collar 830 toward the rotatable cylinder 820. FIG. 10 also illustrates the threads 920 of the threaded rod 910. The threads 920 engage the threads 1030 in the tapered plunger 930 to draw the plunger 930 deeper into the cup 900 or to push the plunger farther out of the cup 900, depending on the direction of rotation of the rotatable cylinder 820 and handle portion 120.

Figure 11:
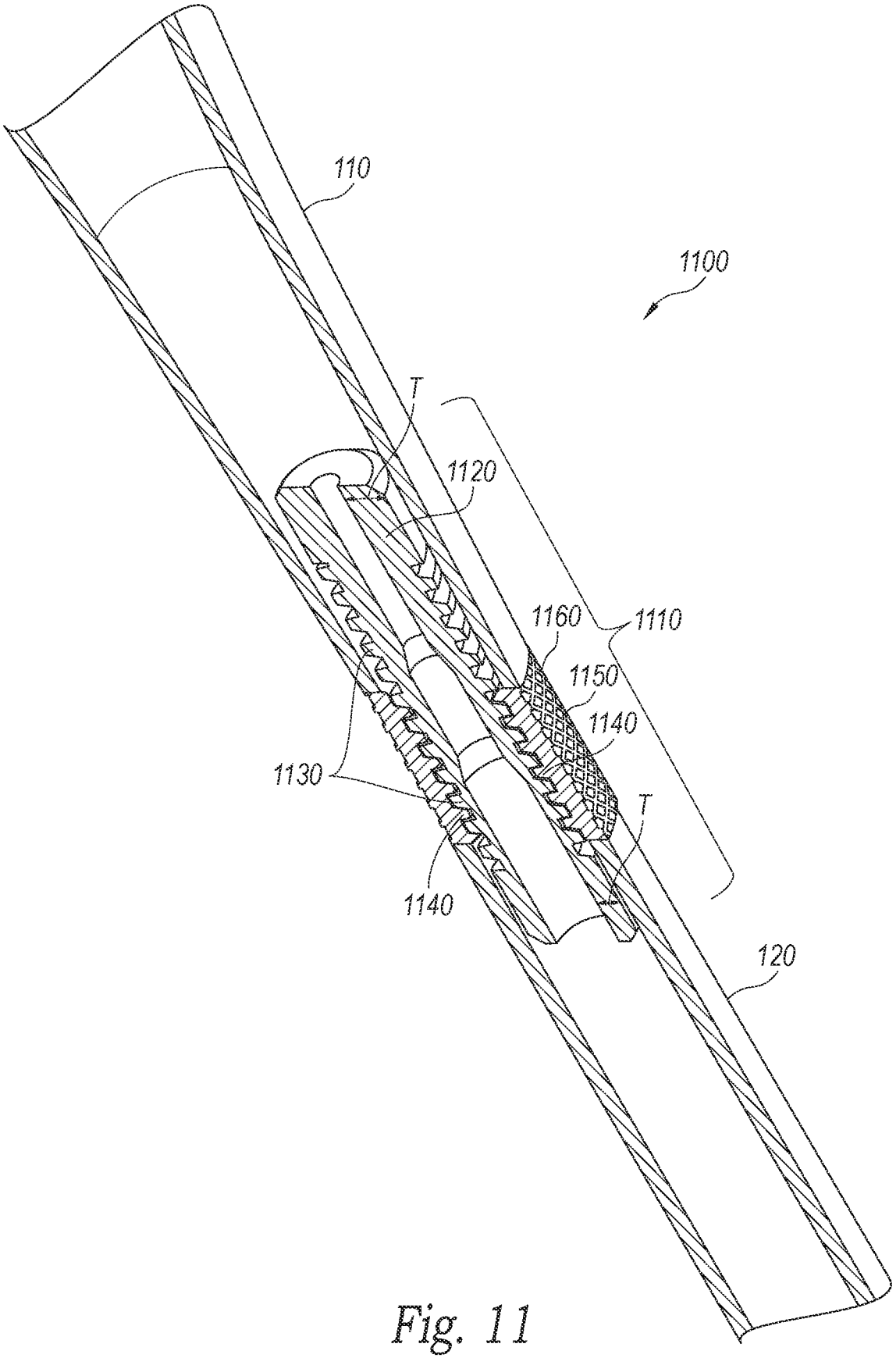
FIG. 11 illustrates a cross section of a portion of a bat having a joint in accordance with another embodiment of the present technology.

FIG. 11 illustrates a cross section of a portion of a bat 1100 having a joint 1110 in accordance with another embodiment of the present technology. The joint 1110 allows a user to adjust flex between the barrel portion 110 and the handle portion 120. The joint 110 includes a flexible rod element or flex rod 1120 positioned inside the joint 1110 that is a primary load-bearing structural link between the barrel portion 110 and the handle portion 120. The flex rod 1120 includes a threaded outer surface 1130, which mates with a threaded inner surface 1140 of a rotatable collar 1150. The rotatable collar 1150 may be fixed to one of the barrel portion 110 or the handle portion 120 such that it is rotatable relative to the other portion. In some embodiments, the rotatable collar 1150 may be rotatable relative to both the barrel portion 110 and the handle portion 120.

A user can rotate the collar 1150, which causes the flex rod 1120 to move along the longitudinal axis of the bat 1100 via forces from the mutually engaged threads 1130, 1140 of the collar 1150 and the flex rod 1120. The flex rod 1120 may have a varying thickness, material, or composition (such as a material described above for the flex rod 220 illustrated in FIGS. 2-5), or a varying cross section along its length that results in varying flexibility along its length. As the flex rod 1120 moves, different portions of the flex rod 1120 become positioned in the load-bearing area of the joint 1110, which is inside the collar 1150. Accordingly, a user can customize the flexibility of the bat 1100 by rotating the collar 1150. In some embodiments, the rotatable collar 1150 may include a knurled surface 1160 to help a user grip the collar 1150.

In a particular representative embodiment, as illustrated in FIG. 11, the flex rod 1120 can be hollow or tubular, with varying wall thickness T along its length. A greater wall thickness T can create more stiffness in the joint 1110, while a lower wall thickness T can create less stiffness and more flexibility in the joint 1110. In some embodiments, the wall thickness T may be between approximately 0.030 inches and 0.250 inches, or other suitable values. In some embodiments, an outer diameter of the flex rod 1120 can be between approximately 0.5 inches and 1.0 inches, or other suitable values. Although the flex rod 1120 is illustrated in FIG. 11 as being hollow, in some embodiments, it may be partially or completely solid. For example, the flex rod 1120 may be solid near where it interfaces with the collar 1150. In some embodiments, the flex rod 1120 can be removed and replaced with other flex rods with other shapes or made of different materials for further customization.

The present technology provides a customizable or modular bat or hitting implement to adjust flexibility, whip effect, or sensation (including shock or sting). In some embodiments, bats or hitting implements according to the present technology can be transported in a smaller shipping container by being disassembled into their constituent parts. In some embodiments, constituent pieces of bats or hitting implements according to the present technology can be sold separately or in variety sets or packs to enhance the user's ability to choose a desired combination of handles, barrels, and connectors to customize swing weights, levels of flexibility, materials, performance (e.g., BBCOR), or other characteristics.

Bats according to embodiments of the present technology may also provide for lower costs in a team environment. For example, a team member may carry only the flex rod, handle, or bat he or she prefers, while others may have other flex rods, handles, or bats to share.

In general, the present technology provides interchangeable or adjustable components in a ball bat or other hitting implement to allow a user to adjust flex, shock transmission, or performance based on governing body regulations or personal preference. The present technology provides means for adjusting flex between a barrel portion and a handle portion.

From the foregoing, it will be appreciated that specific embodiments of the disclosed technology have been described for purposes of illustration, but that various modifications may be made without deviating from the technology, and elements of certain embodiments may be interchanged with those of other embodiments, and that some embodiments may omit some elements. For example, in some embodiments, although handle portions and barrel portions are described, in some embodiments, portions may be replaced with other portions for other sports, such as hockey stick handles and blades, lacrosse stick handles and heads, or cricket bat handles and barrels.

Further, while advantages associated with certain embodiments of the disclosed technology have been described in the context of those embodiments, other embodiments may also exhibit such advantages, and not all embodiments need necessarily exhibit such advantages to fall within the scope of the technology. Accordingly, the disclosure and associated technology may encompass other embodiments not expressly shown or described herein, and the invention is not limited except as by the appended claims.

What is claimed is:

1. A ball bat comprising a barrel portion, a handle portion, and a joint connecting the barrel portion to the handle portion, wherein the joint comprises:

a rotatable collar positioned between the handle portion and the barrel portion; and a flexible rod element positioned inside the rotatable collar; wherein:

the rotatable collar is rotatable relative to at least one of the barrel portion or the handle portion, the rotatable collar is rotatable relative to the flexible rod element, and rotation of the rotatable collar causes the flexible rod element to move along a longitudinal axis of the bat toward the barrel portion or toward the handle portion.

2. The ball bat of claim 1, wherein:

the flexible rod element comprises a threaded outer surface;

the rotatable collar comprises a threaded inner surface; and the threaded outer surface engages the threaded inner surface; wherein rotation of the rotatable collar causes the flexible rod element to move along the longitudinal axis via forces from engagement of the threaded outer surface with the threaded inner surface.

3. The ball bat of claim 1, wherein flexibility of the flexible rod element varies along a length of the flexible rod element, and wherein:

when the flexible rod element is positioned at a first location along the longitudinal axis of the bat, the joint has a first stiffness; and when the flexible rod element is positioned at a second location along the longitudinal axis of the bat, the joint has a second stiffness that is different from the first stiffness.

4. The ball bat of claim 3, wherein along the length of the flexible rod element, the flexible rod element comprises varying materials.

5. The ball bat of claim 3, wherein a cross-section of the flexible rod element varies along the length of the flexible rod element.

6. The ball bat of claim 1, wherein the flexible rod element is hollow and comprises varying wall thickness along a length of the flexible rod element.

7. The ball bat of claim 1, wherein the rotatable collar is rotatable relative to the barrel portion and the handle portion.

8. The ball bat of claim 1, wherein the rotatable collar comprises a knurled outer surface.

9. A ball bat comprising:

a handle portion extending along a longitudinal axis of the bat;

a barrel portion extending along the longitudinal axis;

a flexible rod element positioned between the handle portion and the barrel portion, wherein the flexible rod element extends along the longitudinal axis between a first end of the flexible rod element and a second end of the flexible rod element;

a first connector comprising a first connector portion and a second connector portion, wherein the first connector portion is attached to the first end of the flexible rod element, and the second connector portion is attached to the handle portion; and a second connector comprising a third connector portion and a fourth connector portion, wherein the third connector portion is attached to the second end of the flexible rod element, and the fourth connector portion is attached to the barrel portion; wherein the first connector portion is releasably connected to the second connector portion; and the third connector portion is releasably connected to the fourth connector portion.

10. The ball bat of claim 9, wherein:

the first connector portion comprises a sleeve and the second connector portion comprises a stud; or the first connector portion comprises a stud and the second connector portion comprises a sleeve.

11. The ball bat of claim 10, further comprising a slidable ring positioned to slide over the stud and the sleeve to hold the stud in the sleeve.

12. The ball bat of claim 11, wherein the slidable ring comprises a first threaded portion, the stud comprises a second threaded portion, and wherein the first threaded portion engages the second threaded portion to resist release of the stud from the sleeve.

13. The ball bat of claim 9, wherein the rod element comprises a hollow cylinder.

14. The ball bat of claim 9, further comprising a tether connecting the barrel portion to the handle portion.

15. The ball bat of claim 9, wherein the ball bat comprises a taper portion, and wherein the flexible rod element is positioned in the taper portion.

16. A ball bat comprising:

a barrel portion;

a handle portion; and a joint configured to releasably connect the handle portion to the barrel portion;

wherein:

(a) the joint comprises a first connector portion attached to the handle portion and a second connector portion attached to the barrel portion;

(b) the first connector portion comprises a sleeve and the second connector portion comprises a stud, or the first connector portion comprises a stud and the second connector portion comprises a sleeve;

(c) the ball bat further comprises a slidable ring positioned to slide over the stud and the sleeve to hold the stud in the sleeve; and (d) the slidable ring comprises a first threaded portion, the stud comprises a second threaded portion, and wherein the first threaded portion engages the second threaded portion to resist release of the stud from the sleeve.

17. The ball bat of claim 16, wherein the joint is the only connection between the barrel portion and the handle portion.

18. The ball bat of claim 16, wherein the ball bat comprises a taper portion, and wherein the joint is positioned in the taper portion.

19. A ball bat comprising:

a barrel portion;

a handle portion; and a joint configured to releasably connect the handle portion to the barrel portion;

wherein the joint comprises:

(a) a first connector portion attached to the handle portion;

(b) a second connector portion attached to the barrel portion;

(c) a flexible rod element extending along a longitudinal axis of the bat between a first end of the flexible rod element and a second end of the flexible rod element;

(d) a third connector portion attached to the first end of the flexible rod element; and (e) a fourth connector portion attached to the second end of the flexible rod element;

and wherein:

the first connector portion is releasably connectable to the third connector portion; and the second connector portion is releasably connectable to the fourth connector portion.

20. The ball bat of claim 19, wherein the first connector portion comprises a sleeve and the third connector portion comprises a stud.

21. The ball bat of claim 20, further comprising a slidable ring positioned to slide over the stud and the sleeve to hold the stud in the sleeve.

22. The ball bat of claim 21, wherein the slidable ring comprises a first threaded portion, the stud comprises a second threaded portion, and wherein the first threaded portion engages the second threaded portion to resist release of the stud from the sleeve.

23. The ball bat of claim 19, wherein the second connector portion comprises a sleeve and the fourth connector portion comprises a stud.

24. The ball bat of claim 19, wherein the first connector portion comprises a stud and the third connector portion comprises a sleeve.

25. The ball bat of claim 19, wherein the second connector portion comprises a stud and the fourth connector portion comprises a sleeve.

* * * * *